US007517249B1

(12) United States Patent
Zhang et al.

(10) Patent No.: US 7,517,249 B1
(45) Date of Patent: Apr. 14, 2009

(54) ELECTRICAL CONNECTOR ASSEMBLY HAVING RETENTION STRUCTURE

(75) Inventors: George (Huanyi) Zhang, Irvine, CA (US); Lin Huang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/998,578

(22) Filed: Nov. 30, 2007

(51) Int. Cl.
*H01R 13/648* (2006.01)

(52) U.S. Cl. ..... 439/607

(58) Field of Classification Search ..... 439/570, 439/566, 79, 80, 607, 709
See application file for complete search history.

(56) References Cited

U.S. PATENT DOCUMENTS

| | | | | |
|---|---|---|---|---|
| 4,629,278 | A * | 12/1986 | Norton et al. | 439/570 |
| 4,721,473 | A * | 1/1988 | DelGuidice et al. | 439/79 |
| 6,155,878 | A * | 12/2000 | Chen | 439/607 |
| 6,331,122 | B1 | 12/2001 | Wu | |
| 6,402,562 | B1 * | 6/2002 | Chang et al. | 439/676 |
| 6,435,912 | B1 * | 8/2002 | Zhu et al. | 439/607 |
| 6,471,544 | B1 | 10/2002 | Huang | |
| 6,544,071 | B1 * | 4/2003 | Wu | 439/607 |
| 6,565,366 | B1 * | 5/2003 | Wu | 439/76.1 |
| 6,641,425 | B1 * | 11/2003 | Wu | 439/352 |
| D486,794 | S * | 2/2004 | Okamoto | D13/147 |
| 6,722,919 | B2 * | 4/2004 | Lin | 439/569 |
| 6,752,662 | B2 * | 6/2004 | Okamoto | 439/607 |
| 6,755,671 | B1 * | 6/2004 | Fan et al. | 439/108 |
| 6,786,770 | B1 * | 9/2004 | Huang | 439/607 |
| 6,860,749 | B1 * | 3/2005 | Wu | 439/352 |
| 6,932,647 | B2 * | 8/2005 | Murayama | 439/607 |
| 6,948,980 | B2 * | 9/2005 | Xiang et al. | 439/607 |
| 7,018,237 | B2 * | 3/2006 | Zhan et al. | 439/607 |
| 7,052,286 | B2 * | 5/2006 | Zhang | 439/74 |
| 7,052,320 | B2 * | 5/2006 | Zhang et al. | 439/607 |
| 7,198,519 | B2 * | 4/2007 | Regnier et al. | 439/637 |
| 7,226,314 | B2 * | 6/2007 | Lang et al. | 439/607 |
| 7,238,049 | B1 * | 7/2007 | Wu | 439/607 |
| 7,278,885 | B1 | 10/2007 | Zhang | |
| 7,364,465 | B2 * | 4/2008 | Wu | 439/610 |
| 2002/0173202 | A1 * | 11/2002 | Okamoto | 439/607 |
| 2004/0029444 | A1 * | 2/2004 | Tang | 439/607 |
| 2004/0115990 | A1 * | 6/2004 | Kodama | 439/607 |
| 2005/0245132 | A1 * | 11/2005 | Huang et al. | 439/607 |
| 2006/0025015 | A1 * | 2/2006 | Hu et al. | 439/607 |

(Continued)

OTHER PUBLICATIONS

"SFF-8088 Specification for Compact Multilane shielded connector" published on Mar. 11, 2005 by SFF Committee.

*Primary Examiner*—T C Patel
*Assistant Examiner*—Vladimir Imas
(74) *Attorney, Agent, or Firm*—Wei Te Chung

(57) ABSTRACT

An electrical connector (100) includes an insulated housing (1) having a top wall, a bottom wall, a rear wall and a pair of side walls interconnecting with the top wall, the bottom wall and the rear wall to corporately define a receiving passage (15) along horizontal direction; a plurality of terminals (2) separated into two distinct sets along vertical direction and received in the insulated housing (1); a pair of retaining members (4) assembled to the pair of side walls of the insulated housing to retain the insulated housing on the circuit substrate (5); a metal shell (3) having a plurality of walls cooperatively defining a hollow to receive the insulated housing. The retaining members are at least partially enclosed within the hollow of the metal shell.

20 Claims, 7 Drawing Sheets

U.S. PATENT DOCUMENTS

2006/0040556 A1* 2/2006 Neer et al. ..... 439/607
2006/0134985 A1* 6/2006 Reed et al. ..... 439/607
2006/0264104 A1* 11/2006 Olson et al. ..... 439/607
2007/0099504 A1* 5/2007 Wu ..... 439/607
2007/0128938 A1* 6/2007 Kuo ..... 439/607

* cited by examiner

ELECTRICAL CONNECTOR ASSEMBLY HAVING RETENTION STRUCTURE

BACKGROUND OF THE INVENTION

1. Field of the Invention

The present invention generally relates to an electrical connector assembly, and more particularly to an electrical connector of the electrical assembly having retention structure to prevent an insulated housing to be peeled off a circuit substrate, when a complementary connector mates with the electrical connector.

2. Description of Related Art

A new kind of connector assembly called Mini SAS adapted for high-speed data transmission has been issued by SFF Committee. A spec launched by SFF Committee introduces a compact multilane shielded connector assembly which includes a plug connector and a receptacle connector. The receptacle connector mounted on a circuit substrate comprises an insulated housing having a mating port. The plug connector defines a forward mating segment inserted into the mating port of the insulated housing of the receptacle connector to achieve electrical connection between the plug connector and the receptacle connector.

The insulated housing of the receptacle connector is retained to the circuit substrate via a pair of small position posts. However, when the plug connector mates with the receptacle connector, if an exterior force exerted onto the plug connector is too big, the insulated housing may be peeled off the PCB.

Hence, an improved receptacle electrical connector is highly desired to overcome the disadvantages of the related art.

SUMMARY OF THE INVENTION

Accordingly, an object of the present invention is to provide an electrical connector assembly having retention structure preventing an insulated housing to be peeled off a printed circuit board.

In order to achieve the object set forth, an electrical connector assembly in accordance with the present invention includes an electrical connector which comprises an insulated housing having a top wall, a bottom wall, a rear wall and a pair of side walls interconnecting with the top wall, the bottom wall and the rear wall to corporately define a receiving passage along horizontal direction; a plurality of terminals separated into two distinct sets along vertical direction and received in the insulated housing; a pair of retaining members assembled to the pair of side walls of the insulated housing to retain the insulated housing on the printed circuit board; a metal shell having a plurality of walls cooperatively defining a hollow to receive the insulated housing. The retaining members are at least partially enclosed within the hollow of the metal shell.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 6:
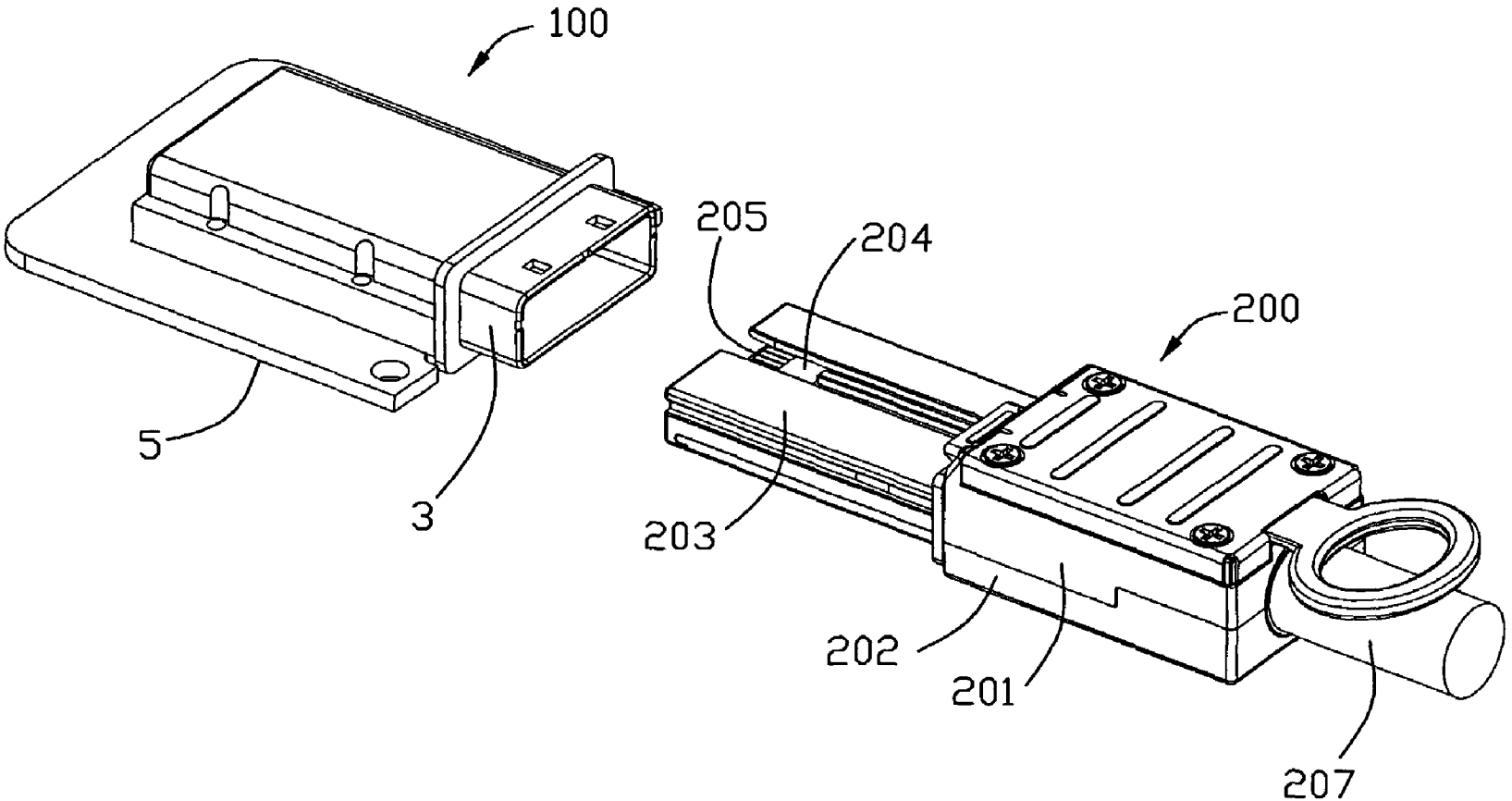
FIG. 6 is an electrical connector assembly including the electrical connector and a complementary connector.

Referring to FIG. 6, an electrical connector assembly comprises an electrical connector 100 and a complementary connector 200.

Figure 1:
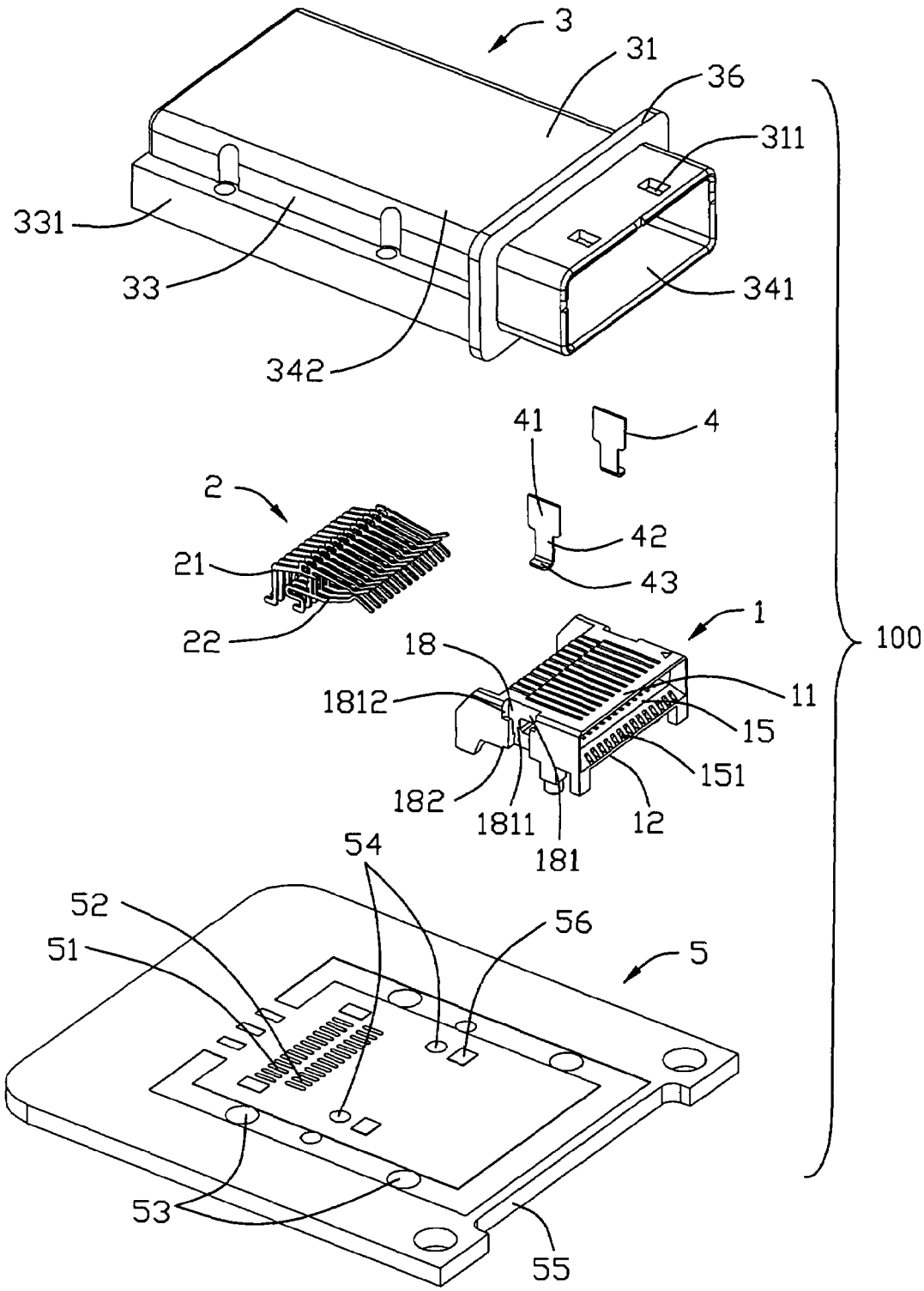
FIG. 1 is an exploded, perspective view of an electrical connector in accordance with the present invention.
Figure 2:
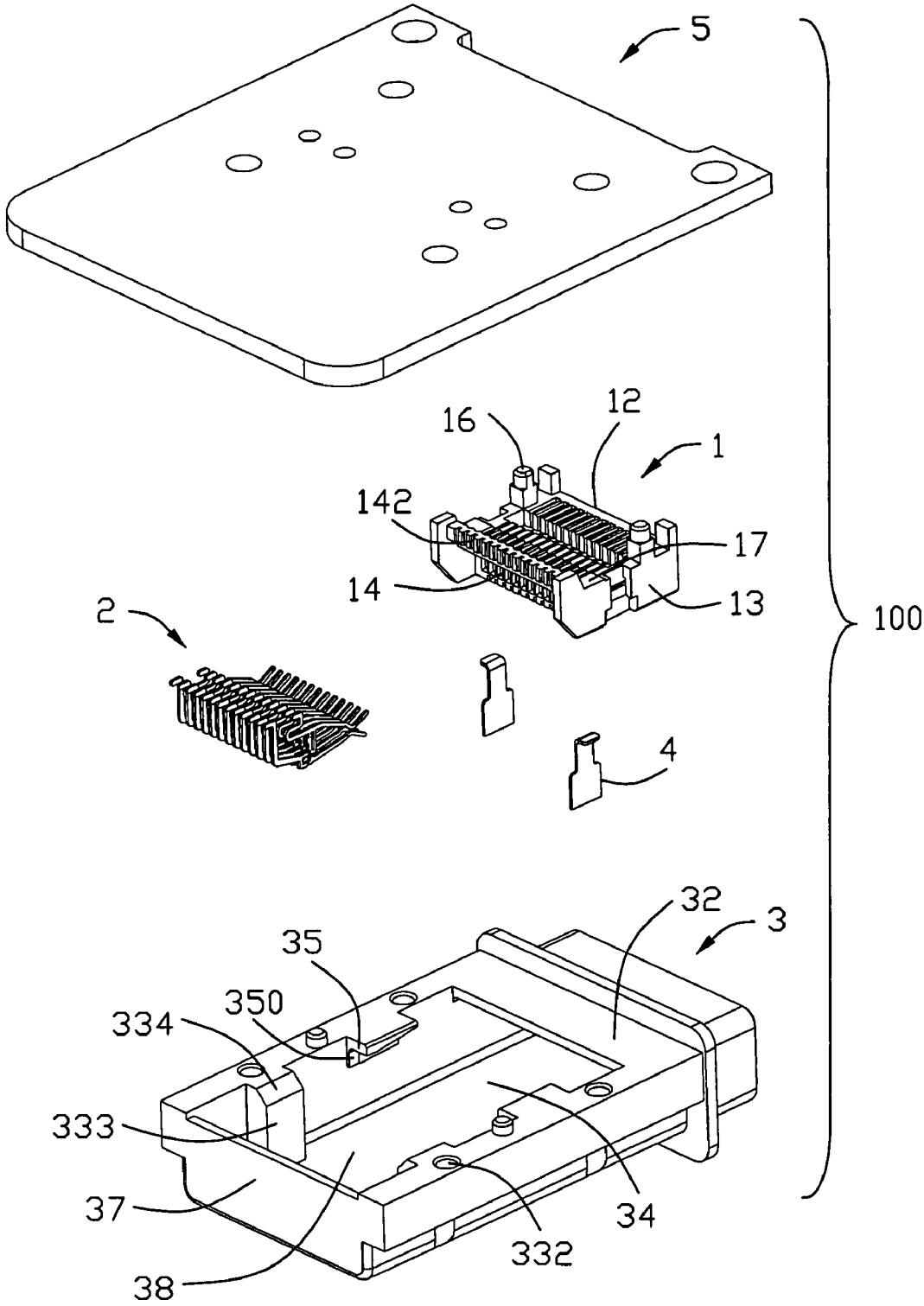
FIG. 2 is a view similar to FIG. 1, but viewed from another aspect.
Figure 3:
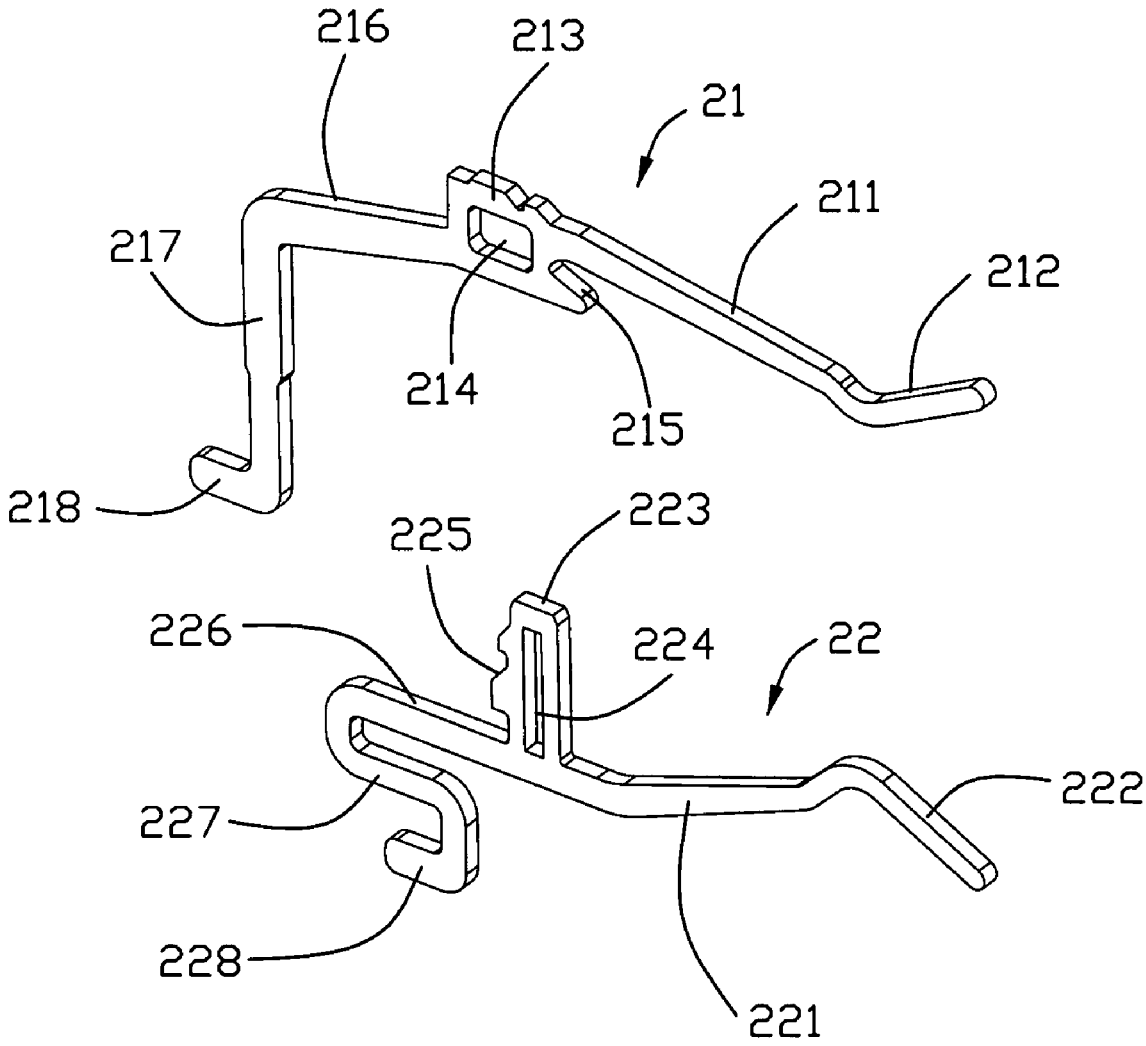
FIG. 3 is an enlarged view of terminals of the electrical connector.

Referring to FIGS. 1-3, the electrical connector 100 comprises an insulated housing 1, a number of terminals 2 received in the insulated housing 1, and a metal shell 3 enclosing the insulated housing 1 and together mounted to a circuit substrate 5. The electrical connector 100 further comprises two retaining members 4 positioning the insulated housing 1 on the circuit substrate 5 reliably.

The insulated housing 1 comprises a top wall 11, a bottom wall 12, a rear wall 14 and a pair of side walls 13 interconnecting with the top wall 11, the bottom wall 12 and the rear wall 14. The top wall 11, the bottom wall 12, the pair of side walls 13 and the rear wall 14 cooperatively enclose a receiving passage 15 along horizontal direction. The receiving passage 15 has an enlarged front opening 151. Part of a lower section of a middle portion of each side wall 13 is cut to form a gateway 17 facing the circuit substrate 5. A positioning post 16 extends downwardly from bottom surface of each side wall 13 and is adjacent to the front opening 151. A plurality of protrusions 142 extend rearward from a lower section of the rear wall 14. The protrusions 142 are aligned in a row along transversal direction and every two adjacent protrusions 142 are separated by a certain distance. Each side wall 13 defines a positioning portion 18. The positioning portion 18 is configured to substantially T-shaped which comprises a rectangular-shaped vertical cavity 181 having an inner first surface 1811 and a pair of side second surfaces 1812, and a pair of L-shaped protruding members 182 respectively formed at lower portions of the second surfaces 1812 and the first surface 1811 to define a pair of retaining slots (not numbered) therebetween.

Referring to FIG. 3, the terminals 2 comprise a set of first terminals 21 and a set of second terminals 22 arranged in two distinct rows along vertical direction. Either the set of first terminals 21 or the set of second terminals 22 are aligned in a row along transversal direction. Each of the set of first terminals 21 includes a forward and downward slant contact beam 211 with an upward curved contact portion 212 formed at a forward end thereof, an expanded retention portion 213 formed at a back end of the contact beam 211, a transition portion 216 slightly inclined extending rearward and downward from a lower section of an end edge of the retention portion 213 and a vertical leg portion 217 downward extending from an end of the transition portion 216 and a foot portion 218 bent rearward at angle about ninety degree to the vertical leg portion 217. The retention portion 213 of each of the set of first terminals 21 further has a rectangular-shaped adjusting hole 214 therein and a tapered protrusion portion 215 formed at lower edge of a forward end of the retention portion 213 and spaced apart from the contact beam 211 at a certain angle.

Each of the set of second terminals 22 includes a forward and upwardly slant contact beam 221 with a curved contact portion 222, a horizontal transition portion 226 extending rearward from an end portion of the contact beam 221, an upright retention portion 223 formed at middle section of the transition portion 226, an inverted zigzag-shaped supporting portion 227 with its top end portion engaging with an end portion of the transition portion 226. The inverted zigzag-shaped supporting portion 227 has a horizontal foot portion 228 stretching backward therefrom. The retention portion 223 is substantially rectangular-shaped with a vertical slot 224 therein and barbs 225 formed on a lateral side thereof. A configuration of the zigzag-shaped supporting portion 227 can control impedance of the terminals 22 and further improve electrical performance of signal transmission.

The metal shell 3 comprises an upper wall 31, a lower wall 32, a back wall 37 and a pair of transversal walls 33. The upper wall 31, the lower wall 32 and the back wall 37 join to the pair of the transversal walls 33 to define a hollow 34. A continues ridge 36 divides the metal shell 3 into a front loop-shaped mating port 341 and a rear section 342. The rear section of the lower wall 32 is cut to form a window 38 to communicate with hollow 34. Two guiding members 35 (FIG. 2) are respectively arranged on inner surfaces of the pair of transversal walls 33. Each guiding member 35 has a substantially L-shaped cross-section and defines a guiding passage 350 along a mating direction. The guiding passage 350 aligns with the mating port 341. An attachment beam 331 is formed at a lower section of the outer surface of each transversal wall 33. Each attachment beam 331 defines a pair of screw holes 332 at a front and a back section thereof for inserting screws (not shown). A pair of vertical posts 333 are respectively formed on the inner surfaces of the transversal walls 33 and nearby the back wall 37. The top portion of each vertical beam 333 is cut to form a chamfer 334 thereon. A pair of locking apertures 311 for latching with a latch mechanism 206 of a complementary connector 200 are defined in the front section of the upper wall 31.

Each retaining member 4 is made of a sheet metal and comprises an upper engaging portion 41, a relative narrower medium portion 42 extending downward from a bottom edge of the upper engaging portion 41 and a foot portion 43 bent at angle of around ninety degrees to and connecting with a lower end of the medium portion 42.

The circuit substrate 5 has a plurality of conductive traces arranged in distinct set of first conductive traces 51 and set of second conductive traces 52. Two pairs of screw holes 53 and a pair of positioning holes 54 are respectively spaced arranged on the circuit substrate 5. A positioning cutout 55 is defined in the front portion of the circuit substrate 5.

Figure 4:
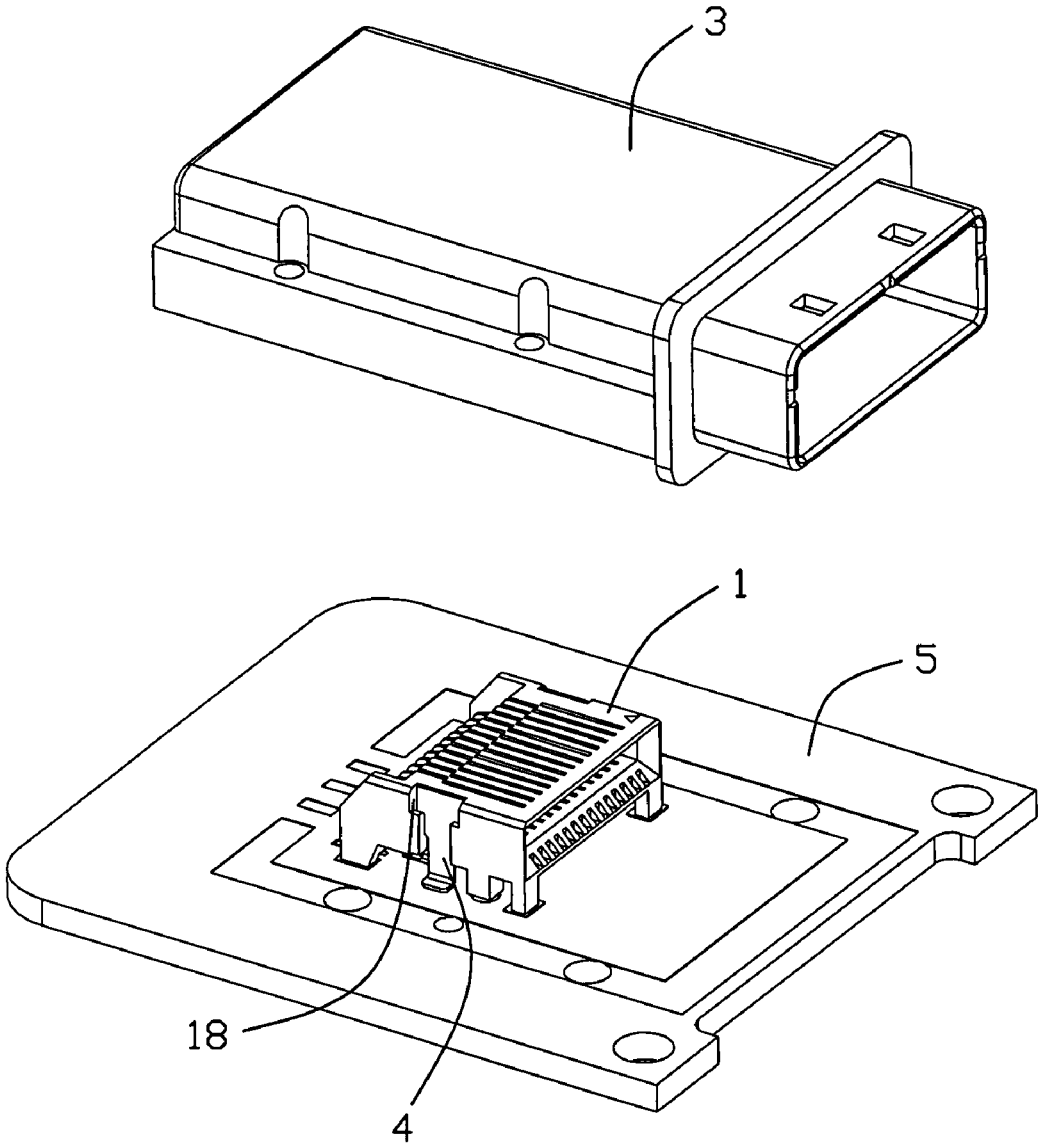
FIG. 4 is a partially assembled, perspective view of the electrical connector.
Figure 5:
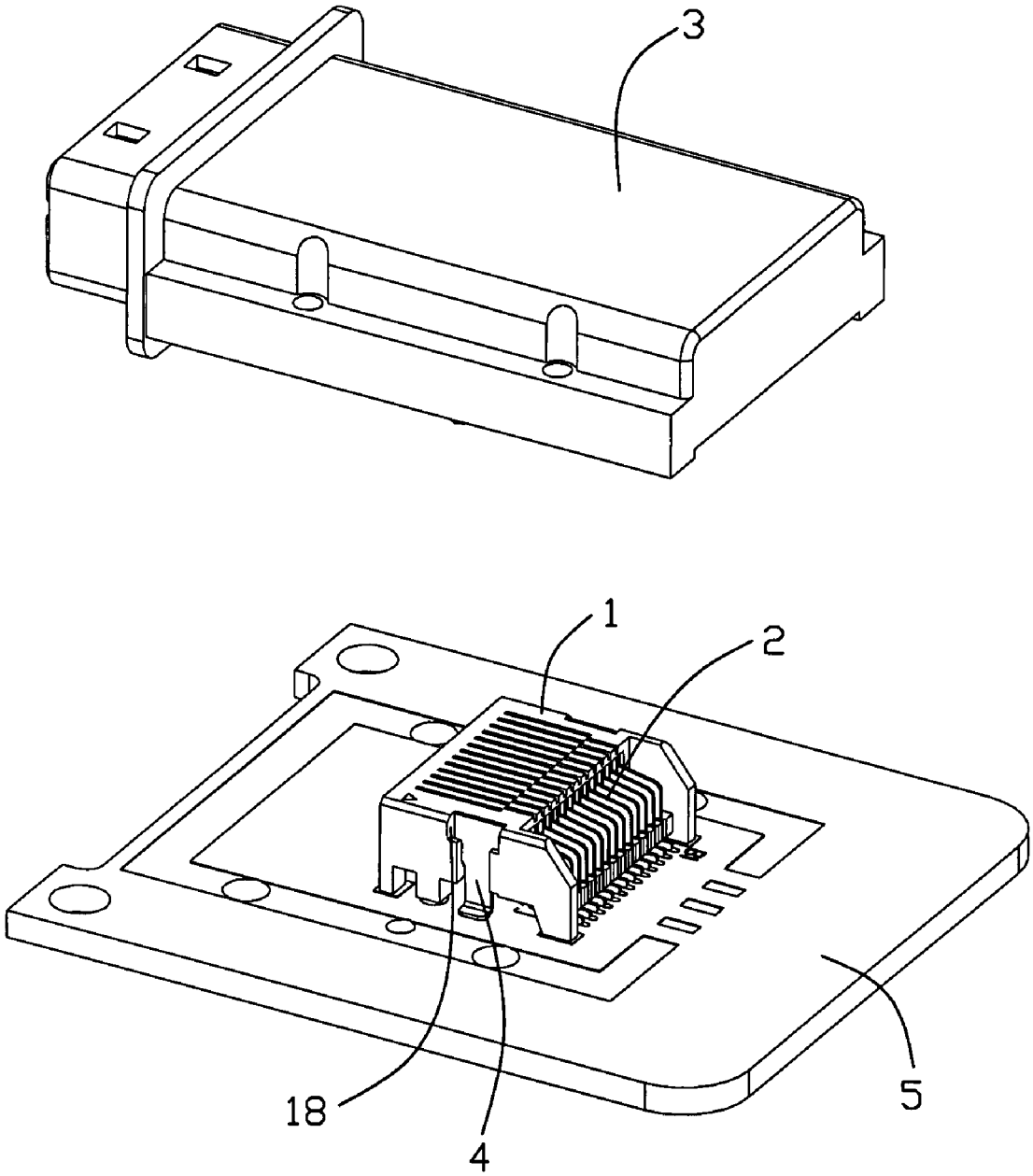
FIG. 5 is a view similar to FIG. 4, but viewed from another aspect.

Referring to FIGS. 4-6 in conjunction with FIGS. 1-3, when assembly, the set of first terminals 21 are assembled to the top wall 11 of the insulated housing 1 along a front-to-back (horizontal) direction, with the contact beams 211 disposed in terminal slots (not numbered) of the top wall 11, the contact portions 212 extending into the receiving passage 15, the retention portions 213 interferentially retained in an upper section of the rear wall 14, the transition portions 216 located above the protrusions 142, and lower sections of the leg portions 217 sandwiched in the gaps (not numbered) formed between two adjacent protrusions 142. Secondly, the set of second terminals 22 are assembled to the bottom wall 12 of the insulated housing 1 along a vertical direction perpendicular to the front-to-back direction, with the contact beams 221 disposed in terminal slots (not numbered) of the bottom wall 12, the contact portions 222 extending into the receiving passage 15, the retention portions 223 inserted into a lower section of the rear wall 14, and zigzag-shaped supporting portion 227 exposed beneath the bottom wall 12. Then, the retaining members 4 are inserted into the positioning portions 18 of the insulated housing 1, with the upper engaging portions 41 being held by the retaining slots (not numbered) of the positioning portions 18, and a lower segment of the medium portions 42 are bent outward to form the foot portions 43. Thirdly, the insulated housing 1 is mounted on the circuit substrate 5, with the positioning posts 16 received in the positioning holes 54 of the circuit substrate 5, the foot portions 218, 228 of the set of first/second terminals 21, 22 respectively disposed on the set of first/second conductive traces 51, 52. Fourthly, the foot portions 218, 228 of the sets of first/second terminals 21, 22 are soldered to the first/second conductive traces 51, 52, and the foot portions 43 also soldered to pads 56 of the circuit substrate 5. Fifthly, the metal shell 3 is assembled to the circuit substrate 5, with the insulated housing 1 entering the hollow 34 through the windows 38 of the metal shell 3, the lower part of the protruding ridge 36 abutting against the positioning cutout 55 defined in the circuit substrate 5, the screw holes 332 of the metal shell 3 aligning with the screw holes 53 of the circuit substrate 5 to allow the screws (not shown) inserted therein to combine the metal shell 3 and the circuit substrate 5 together. It should be awarded that other retaining means, such as screws, locking members which can position the insulated housing 1 on the circuit substrate 5 are also available. The Gateways 17 of the insulated housing 1 facilitate the air flow in soldering process to improve the quality of solder.

Figure 7:
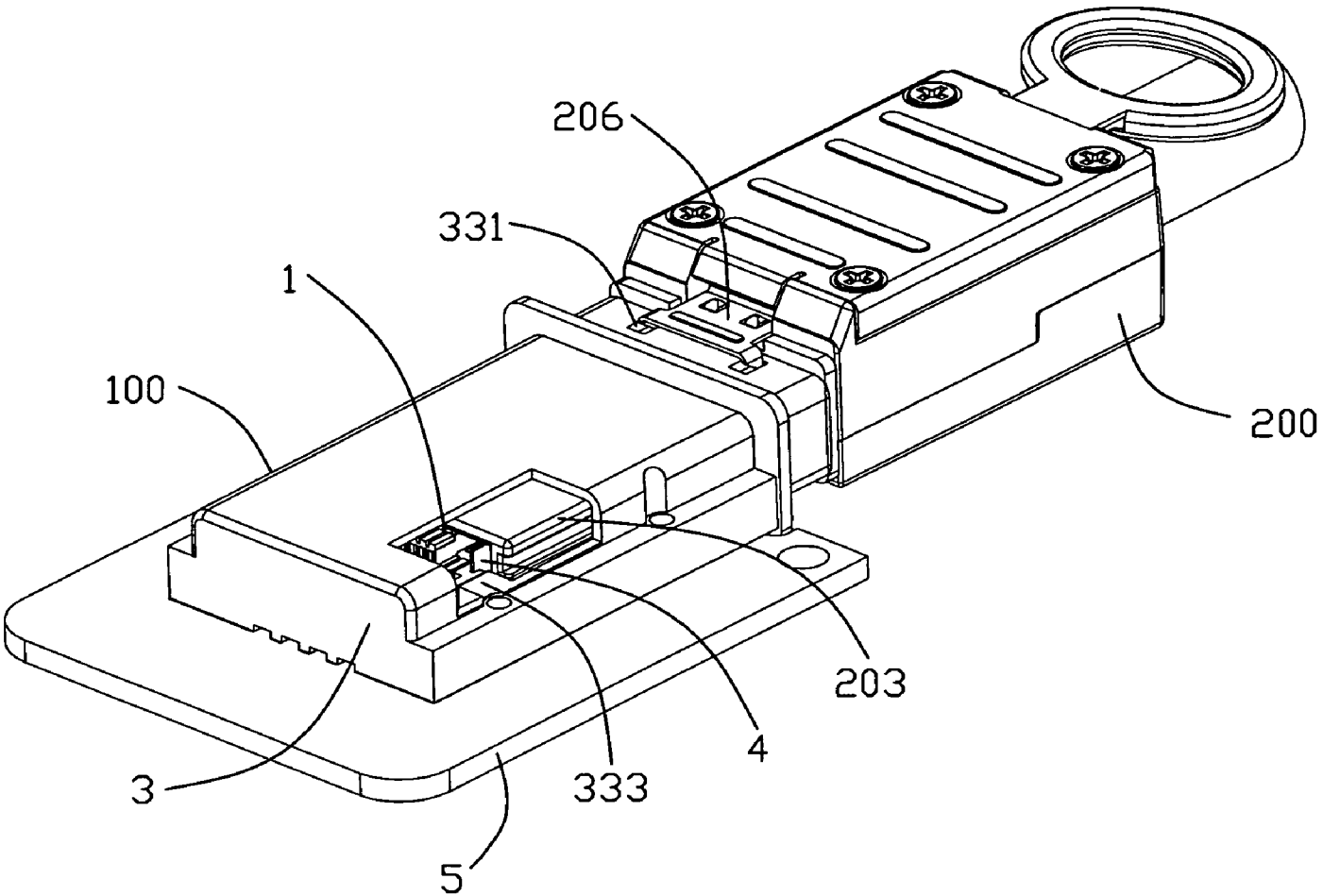
FIG. 7 is the electrical connector assembly in mating status, with partial of a metal shell of the electrically connector being cut out.

Referring to FIGS. 6-7, the complementary connector 200 has a top cover 201 and a bottom cover 202 coupled together to define a receiving space 204 therein. A forward portion of the receiving space 204 enclosing a printed circuit board (PCB) 205 to form a mating segment 203. A plurality of conductive traces (not numbered) arranged on an upper and a lower surfaces of the PCB 205 and further electrically connect to a cable 207. The latch mechanism 206 is arranged on the top cover 201. When the complementary connector 200 mates with the electrical connector 100, the mating segment 203 is firstly inserted into the front mating port 341 of the metal shell 3 and enters into the hollow 34; then slides along the guiding passages 350 of the guiding members 35, and then achieve engagement with the electrical connector 100, with a front segment of the insulated housing 1 and at least partial of each retaining member 4 received/enclosed in a front section of the space 204, the PCB 205 is inserted into the receiving passage 15 with its conductive trades (not numbered) contacting the contact portions 212, 222 of the sets of first and second terminals 21, 22. As the insulated housing 1 is retained on the circuit substrate 5 by the retaining members 4, it may withstand over hitting/pushing of the complementary connector 200. Additionally, a forward segment of the mating segment 203 abuts onto the pair of the vertical posts 333 of the metal shell 3 to further reduce the bigger hitting/pushing force exerted onto the insulated housing 1 by the complementary connector 200.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted on a circuit substrate, comprising:

an insulated housing having a top wall, a bottom wall, a rear wall and a pair of side walls interconnecting with the top wall, the bottom wall and the rear wall to corporately define a receiving passage along horizontal direction;

a plurality of terminals separated into two distinct sets along vertical direction and received in the insulated housing;

a pair of retaining members inserted into the pair of side walls of the insulated housing to retain the insulated housing on the circuit substrate; and a metal shell having a plurality of walls cooperatively defining a hollow;

wherein both the insulated housing and the retaining members are entirely enclosed within the hollow of the metal shell.

2. The electrical connector as claimed in claim 1, wherein each of the retaining members is made of a sheet metal and comprises an upper engaging portion, a relative narrower medium portion extending downward from a bottom edge of the upper engaging portion and a foot portion horizontally extending outward from a lower edge of the medium portion, wherein the upper engaging portion retained in a positioning portion of the side wall of the insulated housing, and wherein the foot portion is adapted for being soldered to the circuit substrate.

3. The electrical connector as claimed in claim 1, wherein the metal shell comprises an upper wall, a lower wall, a back wall and a pair of transversal walls, and wherein the upper wall, the lower wall and the back wall join to the pair of the transversal walls to form the hollow with a front mating port.

4. The electrical connector as claimed in claim 3, wherein part of the rear section of the lower wall is cut to form a window, and wherein the insulated housing is put into the hollow from the window.

5. The electrical connector as claimed in claim 3, wherein the metal shell has a pair of the guiding members respectively formed on inner surfaces of the transversal walls and disposed along a mating direction, wherein each of the guiding members is configured to L-shaped cross-section viewed from back, and wherein each of the guiding members has a guiding passage aligning with the front mating port.

6. The electrical connector as claimed in claim 1, wherein the terminals are separated into a set of first terminals and a set of second terminals, wherein the set of first terminals are assembled to the insulated housing along a front-to-back direction and the set of second terminals are assembled to the insulated housing along a vertical direction.

7. The electrical connector as claimed in claim 1, wherein the front portion of the metal shell has a continuous ridge adapted for abutting against a positioning cutout of the circuit substrate.

8. An electrical connector assembly comprising an electrical connector and a complementary connector, comprising:

the electrical connector for mounting on a circuit substrate, comprising:

an insulated housing having a plurality of walls to corporately define a receiving passage along a mating direction;

a plurality of terminals received in the insulated housing;

a pair of retaining members assembled to a pair of lateral walls of the insulated housing to retain the insulated housing on the circuit substrate;

a metal shell having a plurality of walls cooperatively defining a hollow to receive the insulated housing and fixed to the circuit substrate; and the complementary connector for coupling to a cable, comprising:

a top cover and a bottom cover coupled together to define a receiving space;

a printed circuit board being received in a forward portion of the receiving space to form a mating segment; and wherein when the complementary connector mates the electrical connector, a forward segment of the insulated housing together with the retaining members received in the mating segment of the complementary connector, and the printed circuit board of the complementary connector forms electrical connection with the terminals of the electrical connector.

9. The electrical connector assembly as claimed in claim 8, wherein the metal shell comprises an upper wall, a lower wall, a back wall and a pair of transversal walls to together form the hollow with a front mating port, wherein the insulated housing is disposed at the back segment of the hollow.

10. The electrical connector assembly as claimed in claim 9, wherein the metal shell further forms a pair of vertical beams respectively formed on the rear sections of the transversal wall, and wherein a forward portion of the mating segment of the complementary connector abuts onto the vertical beams to prevent the mating segment overly hitting the insulated housing.

11. The electrical connector assembly as claimed in claim 8, wherein the terminals are separated into a set of first terminals and a set of second terminals, wherein the set of first terminals are assembled to the insulated housing along a front-to-back direction and the set of second terminals are assembled to the insulated housing along a vertical direction.

12. The electrical connector assembly as claimed in claim 8, wherein the insulated housing having a top wall, a bottom wall, a rear wall and a pair of side walls interconnecting with the top wall, the bottom wall and the rear wall to corporately define a receiving passage along horizontal direction.

13. The electrical connector as claimed in claim 12, wherein the insulated housing further comprises a pair of positioning posts extending downwardly from the bottom of the side walls respectively, wherein the pair of positioning posts are received in the positioning holes of the printed circuit board of the electrical connector.

14. The electrical connector as claimed in claim 12, wherein each side wall with part of middle portion defines a gateway recessed upward from the bottom surface of the side wall.

15. The electrical connector as claimed in claim 12, wherein the rear wall of the insulated housing forms a plurality protrusions extending rearward therefrom, and wherein each first terminal has a rear portion sandwiched between two adjacent protrusions.

16. An electrical connector assembly comprising:

a printed circuit board, an insulative housing mounted upon the printed circuit board spaced away from a front edge of the printed circuit board with a distance;

a plurality of contacts disposed in the housing;

a metallic retaining device holding the housing on said printed circuit board;

a metallic shell defining a horizontal receiving cavity with a bottom through hole to receive said housing herein, said shell defining a flange essentially seated on said front edge; and a mating connector having a metallic front mating section inserted into the receiving cavity; wherein said front mating section separates the retaining device and the shell in a transverse direction.

17. The electrical connector assembly as claimed in claim 16, wherein said shell defines a raised island section on a middle region of a cross-sectional configuration.

18. The electrical connector assembly as claimed in claim 1, wherein a pair of positioning portions are respectively defined in the pair of side walls and through an up and bottom surfaces of the side walls.

19. The electrical connector assembly as claimed in claim 18, wherein the positioning portions are laterally in communication to an exterior.

20. The electrical connector assembly as claimed in claim 19, wherein each of the retaining members has a body portion held by the positioning portion and a foot portion laterally extending from a bottom edge of the corresponding retaining member and disposed outside of the positioning portion.

* * * * *